United States Patent [19]

Gollnick et al.

[11] 4,197,905

[45] Apr. 15, 1980

[54] REGENERATIVE-AIR PREHEATER

[75] Inventors: Wilhelm Gollnick; Ernst Wirz, both of Ratingen, Fed. Rep. of Germany

[73] Assignee: Balcke-Dürr Aktiengesellschaft, Ratingen, Fed. Rep. of Germany

[21] Appl. No.: 902,387

[22] Filed: May 3, 1978

[30] Foreign Application Priority Data

May 11, 1977 [DE] Fed. Rep. of Germany ..... 2721061

[51] Int. Cl.[2] ..... F28D 17/00

[52] U.S. Cl. ..... 165/4; 165/7

[58] Field of Search ..... 165/4, 7; 138/37, 39; 366/336

[56] References Cited

U.S. PATENT DOCUMENTS

| | | | |
|---|---|---|---|
| 646,378 | 3/1900 | Szamatolski | 138/39 X |
| 2,426,833 | 9/1947 | Lloyd | 366/336 X |
| 3,481,392 | 12/1969 | Woolard et al. | 165/7 |
| 3,538,982 | 11/1970 | Fiori | 165/7 |

*Primary Examiner*—Albert W. Davis, Jr.
*Attorney, Agent, or Firm*—Martin A. Farber

[57] ABSTRACT

A regenerative air preheater with guide devices serving the supply and exhaust of flue gas as well as air to be heated from at least two separated partial streams and with a heat exchanger body, which heat exchanger body, by means of a relative movement between the guide devices and the heat exchanger body, alternately has passed through it heat emitting flue gas and air to be heated, whereby the temperature of the separated partial streams is regulatable. On the side of the flue gas outlet from the heat exchanger body between the dome-like guide devices for the air to be heated, a cover cap is arranged in the vicinity of one exhaust gas partial stream, which cover cap is provided with individual exhaust channels for transporting of the one exhaust gas partial stream into the other exhaust gas partial stream.

4 Claims, 5 Drawing Figures

REGENERATIVE-AIR PREHEATER

Figure 2:
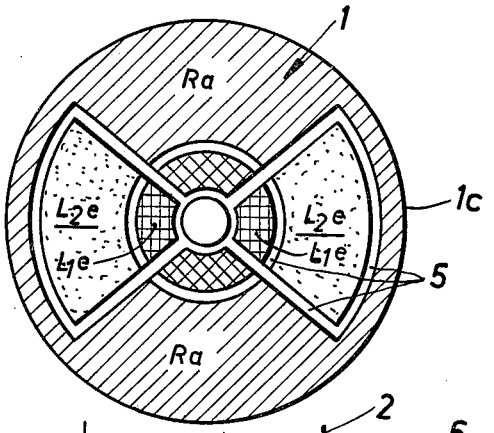
Fig.2 (PRIOR ART)

The invention relates to a regenerative air preheater with guide devices serving the supply and exhaust of flue gas as well as air to be heated from at least two separated partial streams and with a heat exchanger body, which heat exchanger body, by means of a relative movement between the guide devices and the heat exchanger body, alternately has passed through it heat emitting flue gas and air to be heated, whereby the temperature of the separated partial streams of the air is regulatable, for example by means of a recuperative air preheater arranged in the flow direction in front of the heat exchanger body.

Regenerative air preheaters of the previously described type are known. While earlier, for example with pulverized coal-fired steam boilers, with respect to the main air and mill air, it was necessary to provide the preheating of separate air streams by means of separate aggregates or units, the introductory-mentioned multiple current regenerative air preheater illustrates a space saving and cost saving solution. However it possesses the disadvantage that the flue gases in the regenerative air preheater which exit from the steam boiler and are uniformly or constantly tempered, as a result of the different quantity and temperature of the individual partial streams of the air which is to be heated, and indeed on the basis of the different fuel composition, can experience a different cooling in the heat exchanger body, which does not exclude temperature differences of more than 100 degrees Celsius. Since the partial streams of the air to be heated lie concentrically to one another, also there is produced a hot flue gas streak on the flue gas side, which flue gas streak is not dispersed with the known constructions of the regenerative air preheaters or is only very insufficiently dispersed. Such type of hot flue gas streaks however produce problems with the introduction of the flue gas in the filter which is connected following at the outlet, since here temperature differences above from 10 degrees C. are very disadvantageous. Moreover a detrimental influence of the temperature-streaks is produced on channels, baffle plates, blowers or fans, etc.

The invention is based on the task to provide a regenerative air preheater of the introductory described type with at least two separated partial streams of the air to be heated, which in spite of different temperatures in these partial streams guarantees a constant outlet temperature of the flue gasses.

The solution of this task by the invention is characterized in that, on the side of the flue gas outlet from the heat exchanger body between the dome-like guide devices for the air to be heated, a cover cap is arranged in the vicinity of one exhaust gas partial stream, which cover cap is provided with individual exhaust channels for transporting of the one exhaust gas partial stream into the other exhaust gas partial stream. Preferably the hotter exhaust gas stream is transported into the cooler exhaust gas partial stream.

With this proposal of the invention, by means of simple constructive means, a forced distribution and transfer of one of the flue gas partial streams into the other flue gas partial stream is achieved and thereby there is guaranteed a uniform mixing of the flue gas streams of different temperature, so that in the exhaust gas channel which is connected following the regenerative air preheater and consequently in front of the filter, a temperature level is guaranteed which is uniform or constant over the entire flow cross-section.

According to a further feature of the invention the exhaust channels are formed as radially extending exhaust gas tubes, the outlet cross-section of which is wedge-shaped extending over the entire width of the prevailing or particular exhaust gas partial stream. With a preferred embodiment form of the invention the radially extending exhaust gas channels are slotted, wedge-shape with points pointing to the center of the air preheater, whereby a particularly simple and inexpensive formation is produced.

Figure 1:
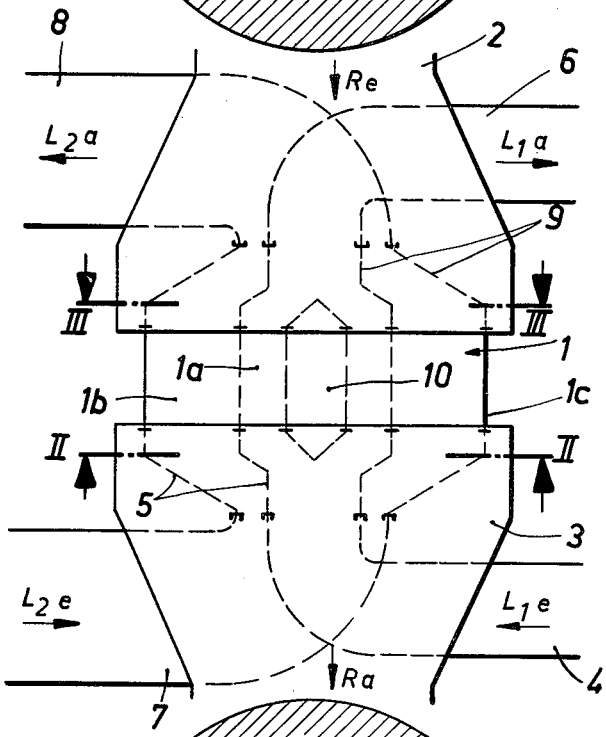
Fig.1 (PRIOR ART)
Figure 3:
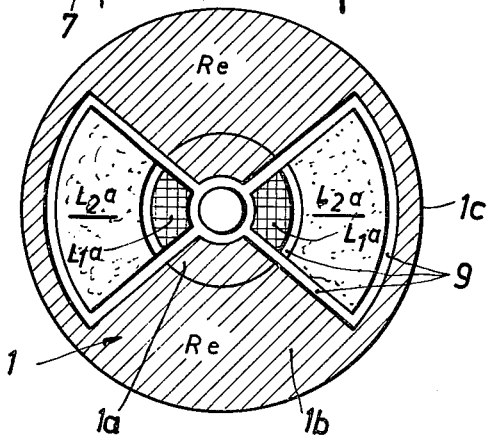
Fig.3 (PRIOR ART)
Figure 4:
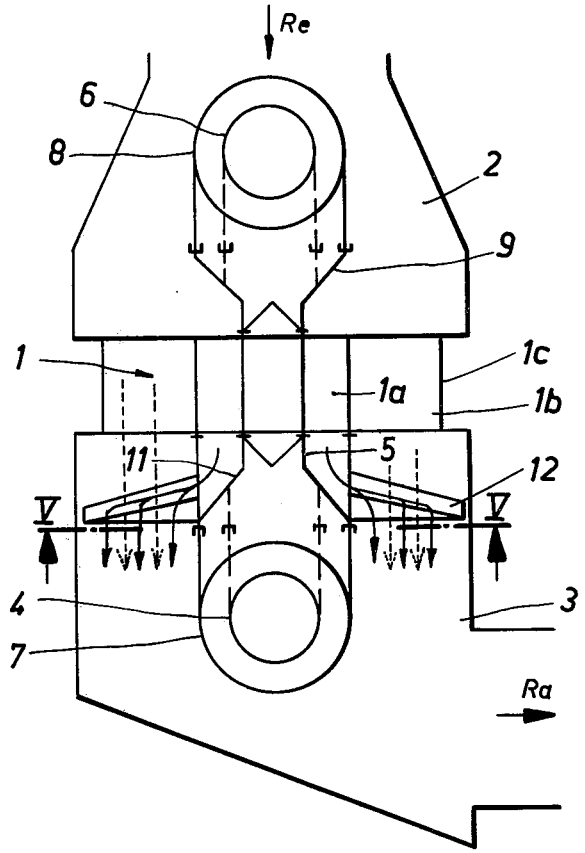
Figure 5:
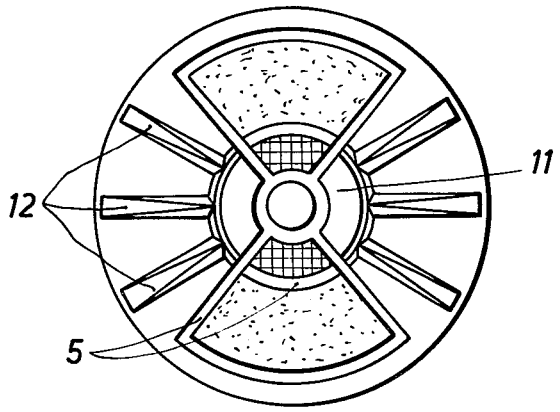

One embodiment example of the regenerative air preheater in accordance with the invention is illustrated on the drawing, and indeed it shows:

FIG. 1 is a schematic drawing of the type of a vertical section through a regenerative air preheater of the known type, FIG. 2 is a cross-section according to the section line II—II in FIG. 1, FIG. 3 is a cross-section according to the section line III—III in FIG. 1, FIG. 4 is a longitudinal section through the regenerative air preheater in accordance with the invention rotated by 90° relative to the illustration in FIG. 1 and FIG. 5 is a cross-section according to the section line V—V of FIG. 4.

The regenerative air preheater illustrated in FIGS. 1 to 3 serves merely as an illustration of the flue gas and air flow, respectively. With the illustrated embodiment, a heat exchanger body 1 is fixedly or stationarily arranged, the heat exchanger elements of which are divided by intermediate walls in an inner ring 1*a* and an outer ring 1*b* and are surrounded by a stator housing 1*c*.

In the illustrated embodiment the flue gas arrives from above via a flue gas entrance housing 2 in the heat exchanger body 1. The flue gas which flows-in is designated with $R_e$. Underneath the heat exchanger body 1 likewise there is disposed a stationary flue gas outlet housing 3. The flue gas leaves this housing 3 (see arrow Ra).

The regenerative air preheater illustrated in FIGS. 1 to 3 serves for heating up two separate air partial streams which lie concentric to one another, which partial streams are designated as primary air and secondary air, respectively.

With the illustrated embodiment the primary air, which flows through the inner ring 1*a* of the heat exchanger body 1 alternately and in countercurrent to the flue gas, enters through a primary air entrance channel 4. The in-flowing primary air is designated with the arrow $L_{1e}$. Moreover secondary air is fed through a secondary air entrance channel 7 concentrically about the primary air; the secondary air entrance is designated with the arrow $L_{2e}$.

The primary air as well as also the secondary air are introduced through a hood or dome-like lower guide device 5 into the heat exchanger body 1. This guide device 5 rotates with a constant speed about a vertical axle or axis and insures that the primary air flows through the heat exchanger elements of the inner ring 1*a* and the secondary air flows through the heat exchanger elements of the outer ring 1*b* of the heat exchanger body 1.

After flowing through the heat exchanger body 1, the primary air and secondary air arrive, via an upper dome-like guide device 9, into the corresponding discharge channels. The guide device 9, which rotates in correspondence to the guide device 5, guides the existing primary air $L_{1a}$ into a primary air exit channel 6 and the secondary air $L_2$ which exits from the heat exchanger body 1 into a secondary air exit channel 8. Both guide devices 5 and 9 are preferably secured on a common shaft, which shaft is not illustrated in the drawings, on which merely a shaft housing 10 surrounding this shaft is to be recognized.

The previously described facts are also illustrated in FIG. 2. The inclined hatching shows the surface of the flue gas outlet. The checkered sketched surface inside of the guide device 5 shows the cross-section which is passed by the entering primary air, whereas the corresponding cross-section for the entering secondary air is illustrated dots. Also the cross-section according to FIG. 3 is provided with the same characterization, from which the flue gas entrance $R_e$, the primary air outlet $L_{1a}$ and the secondary air outlet $L_{2a}$ is to be recognized.

Since the heat exchange quantities between the primary air and the heat exchanger body 1 on the one hand and the secondary air and the heat exchanger body 1 on the other hand based on a single heat exchanger element in general are different, the flue gases in the inner ring 1*a* and the outer ring 1*b* of the heat exchanger body 1 are cooled differently, which flue gases flow through the heat exchanger body 1 in counter-current to the air. This means that in the part (which is cross-hatched in FIG. 1) of the flue gas exit cross-section, a different flue gas temperature prevails than in the remaining cross-section. Thereby hot flue gas streaks are produced, which with the known construction according to FIGS. 1–3 do not disperse or dissipate or only very insufficiently disperse and have the consequence of considerable problems in a filter which is connected at the outlet after the regenerative air preheater. This is true equally for channels, baffle plates, blowers or fans, etc.

These problems are avoided in the manner that according to the illustration in FIGS. 4 and 5, on the side of the flue gas exhaust or outlet from the heat exchanger body 1 between the dome-like guide devices 5 for the primary air and secondary air, respectively, which are to be received, cover caps 11 are arranged in the region of a partial stream of the exhaust flue gas. With the illustrated embodiment this cover cap 11 is located in the vicinity of the inner ring 1*a* of the heat exchanger body 1. This cover cap 11 is provided with individual exhaust flue gas channels 12 for transferring this exhaust flue gas partial stream flow into the other exhaust flue gas partial stream. Preferably the hotter exhaust gas partial stream is transported from the inner ring 1*a* into the colder exhaust gas partial stream (illustrated by dotted arrows) in the vicinity of the outer ring 1*b*. By this cover cap 11 and the exhaust channels 12, with a type of construction of the regenerative air preheater, which construction as to the remainder is unchanged, there is achieved a compulsory or forced transportation of one flue gas partial stream into the other flue gas partial stream and therewith an uniform mixing of the flue gas partial streams of different temperatures, so that in the exhaust gas channel which is connected at the outlet after the regenerative air preheater and therewith before the filter, there is guaranteed a temperature level in the flue gas, which level is uniform over the entire flow cross-section.

The previously described construction which has been illustrated on the basis of one embodiment example, evidently also allows the use of regenerative air preheaters, with which, the guide devices 5 and 9 are not rotatingly driven as with the illustrated embodiment, but rather a rotating drive of the heat exchanger body takes place with stationary or fixed guide devices. Beyond that the construction is not limited to standing air preheaters, that is performing a relative movement about a vertical axis, but rather it can likewise be used on such regenerative air preheaters whose axis of rotation lies horizontal or inclined. Of course it is also further possible to transport the outer flue gas partial stream into the inner flue gas partial stream.

With the illustrated embodiment, the exhaust (or flue) gas channels 12 are formed as tubes which are rhombic in cross-section, which tubes are arranged in radial direction on the dome-like guide device 5. By an inclination or sloping of these exhaust gas channels 12 in the direction of the discharging flue gas and by an interruption or break opening of these exhaust gas channels 12 on the lower side, there results a wedge-shaped outlet cross-section, which wedge-shaped outlet cross-section extends over the entire width of the prevailing exhaust gas partial stream, which cross-section is to be best recognized in FIG. 5, and guarantees a good thorough mixing of the flue gas partial streams.

What is claimed is:

1. In a regenerative air preheater with dome-like guide devices serving for the supply and discharge of flue gas as well as for air to be heated from at least two separated partial streams and with a heat exchanger body, the latter alternately, by means of a relative movement between the guide devices and heat exchanger body, has passed through it heat emitting flue gas and the air to be heated, whereby the temperature of the separated partial streams of air is regulatable, the improvement comprising a cover cap being arranged, in a region of a partial stream of the flue gas on the discharge side of the flue gas from the heat exchanger body, between the dome-like guide devices for the air to be heated, said cover cap being formed with a plurality of individual exhaust channel means for transferring said partial stream of flue gas into another partial stream of flue gas.

2. In the regenerative air preheater according to claim 1, wherein said exhaust channel means are formed as exhaust tubes radially extending from said cover cap.

3. In the regenerative air preheater according to claim 1, wherein said exhaust channel means are formed with outlet cross-sections extending wedge-shaped over the entire width of said another partial stream of flue gas.

4. In the regenerative air preheater according to claim 2, wherein said radially extending exhaust channel means are slotted wedge-shaped with points pointing to a center of the regenerative air preheater.

* * * * *